United States Patent [19]

Granger et al.

[11] 3,998,120

[45] Dec. 21, 1976

[54] APPARATUS FOR THE SIMULTANEOUS DISTRIBUTION AND CUTTING OF STRIPS OF ROLLED MATERIALS

[75] Inventors: Maurice Granger, Saint-Etienne-Loire; Andre Lerond, Villeurbanne-Rhone, both of France

[73] Assignee: Sebas S.A. Societe d'Exploitation d'Appareils Sanitaires, Geneva, Switzerland

[22] Filed: Apr. 2, 1975

[21] Appl. No.: 564,358

[30] Foreign Application Priority Data

Apr. 5, 1974 France ..... 74.12888
Dec. 4, 1974 France ..... 74.43618

[52] U.S. Cl. ..... 83/335; 83/341; 83/349; 83/649

[51] Int. Cl.[2] ..... B26D 1/38

[58] Field of Search ..... 83/335, 334, 341, 349, 83/649; 225/42, 46, 47

[56] References Cited

UNITED STATES PATENTS

| | | | |
|---|---|---|---|
| 1,002,958 | 9/1911 | Avery | 83/335 X |
| 1,467,481 | 9/1923 | Juline | 83/649 X |
| 1,723,325 | 8/1929 | Boomershine | 83/349 X |
| 2,051,242 | 8/1936 | Birr et al. | 83/334 X |
| 3,739,965 | 6/1973 | Jespersen et al. | 83/334 X |

*Primary Examiner*—Frank T. Yost
*Attorney, Agent, or Firm*—Haseltine, Lake & Waters

[57] ABSTRACT

Dispensing apparatus for rolled-up strips of wound sheet material with said sheet material so positioned as to be unwound by means of an abutting rotatable and controllable drum including a cutting device for said stripped material.

13 Claims, 14 Drawing Figures

37
31
29
32
5b
29
34
29a
34a
34b
5d
34c
36a
2a
36
35
35a
36b 5b
24
21
5f
19a
19
5e
23
20
19a 40
20
18
R
39
38

APPARATUS FOR THE SIMULTANEOUS DISTRIBUTION AND CUTTING OF STRIPS OF ROLLED MATERIALS

The invention relates to an apparatus for the simultaneous distribution and cutting of strips of rolled materials.

The invention relates to the technical fields of the handling of flat and strip-shaped materials and also toilet and packing accessories.

According to the invention it seemed necessary to modify certain elements or mechanisms tc improve the efficiency of the apparatus while simplifying its manufacture and the assembly of its components, so as to reduce its sale price.

According to a first feature the apparatus comprises three essential elements, namely: the wall-mounted casing and its hood, the roll support and the unit supporting the cutting mechanisms; these two latter elements are connected to the casing by simple latching of portions of suitable shape on to matching portions of the casing.

According to another feature the cutting mechanism, comprising a movable cutting blade and a fixed matching cutting blade which part the material after the fashion of shears, has coaxially with the drum axis a sectional pawl which performs three functions, namely the escape of the anti-return dog, a camming effect to intercept the shock absorber or parachute of the drum after cutting, and the rebound stretching the material between the roller and the drum.

In variant embodiments the apparatus is characterised in that the fixed and movable members performing cutting are very thin spring steel blades, the material being cut and distributed either by manual pulling or by taking action on a pedal controlling the rotation of the drum which is mounted eccentrically or has a raised form in front of the cutting member.

These features and others will be gathered from the following description, illustrated, but not limited, by the accompanying drawings, wherein.

Figure 4:
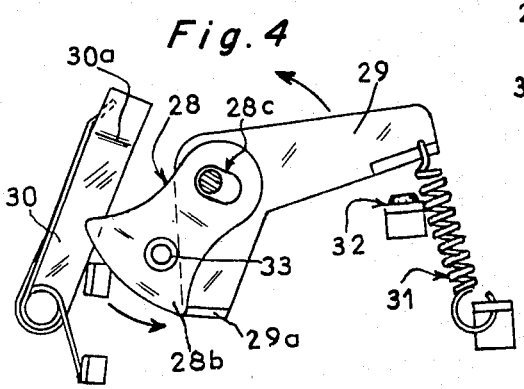
Figure 5:
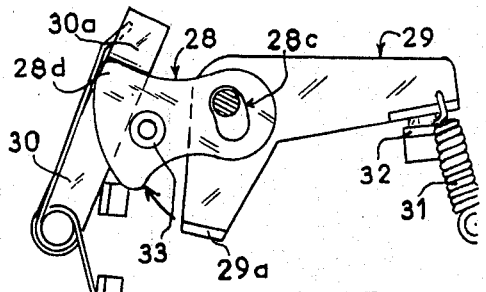

FIGS. 4 and 5 together illustrate the pawl-parachute-dog assembly in the positions of deceleration by the parachute and the abutment of the pawl against the dog respectively.

Figure 6:
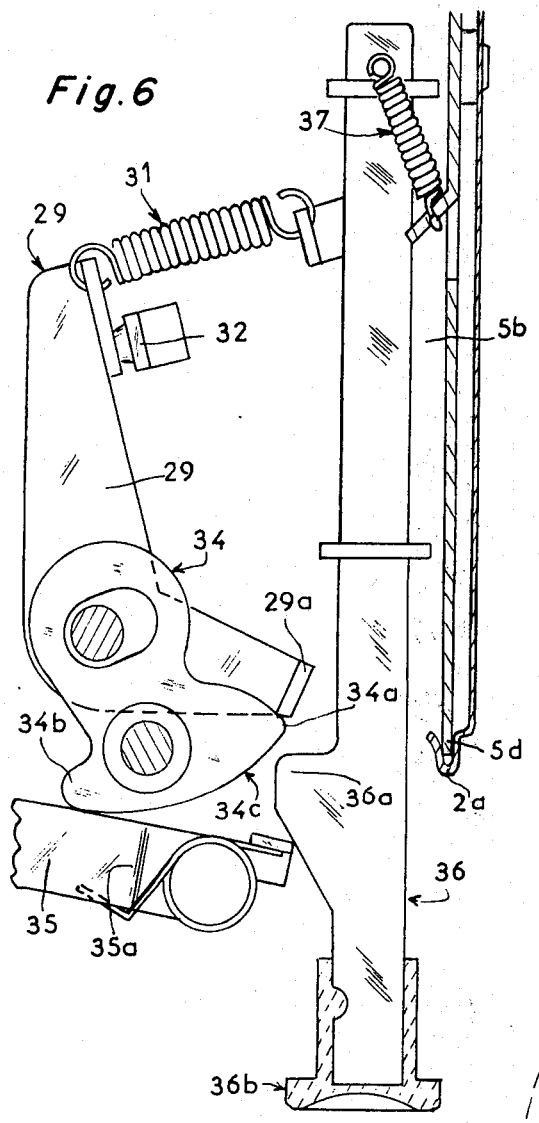

FIG. 6 shows a variant embodiment of the pawl and dog for an apparatus with controlled distribution — i.e., requiring manual action to be taken on an unlocking member to pull and cut a second strip of material.

Figure 7:
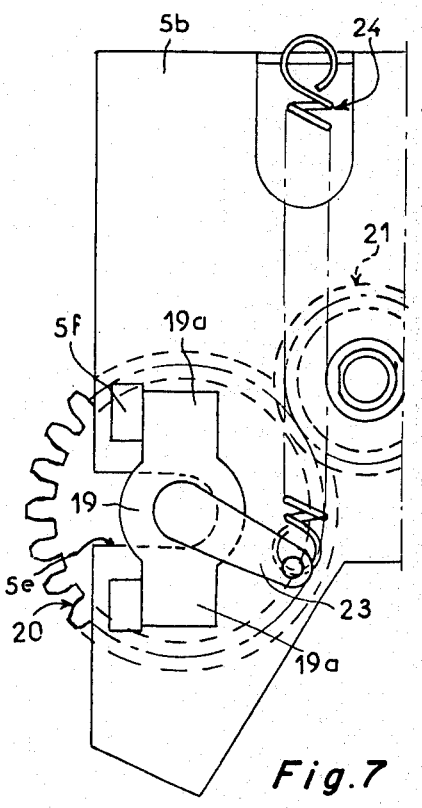

FIG. 7 is a sectional view of the unit supporting the mechanisms on the side of the drive pinions, the unit being shown in its position at the start of cutting.

Figure 8:
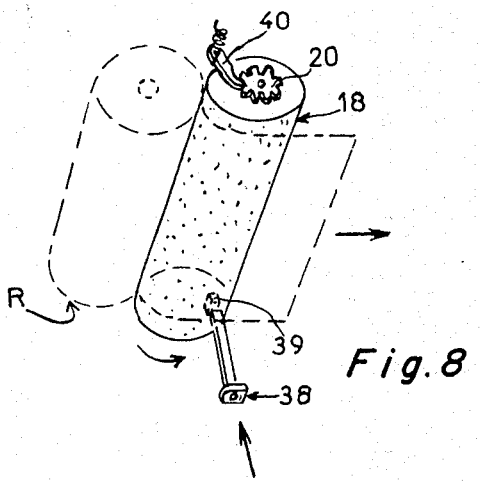

FIG. 8 is a diagrammatic perspective view illustrating the variant for the supply of the material.

Figure 9:
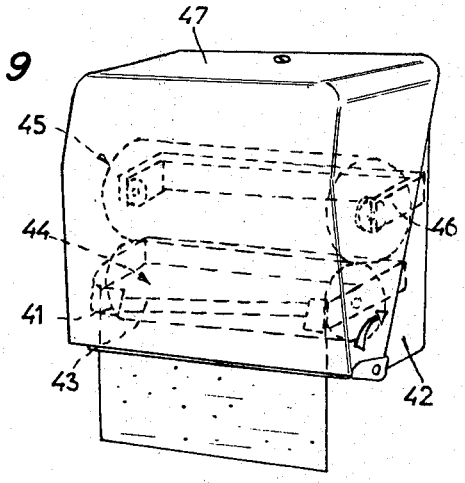

FIG. 9 is a diagrammatic perspective view recalling the main arrangements of the apparatus.

Figure 10:
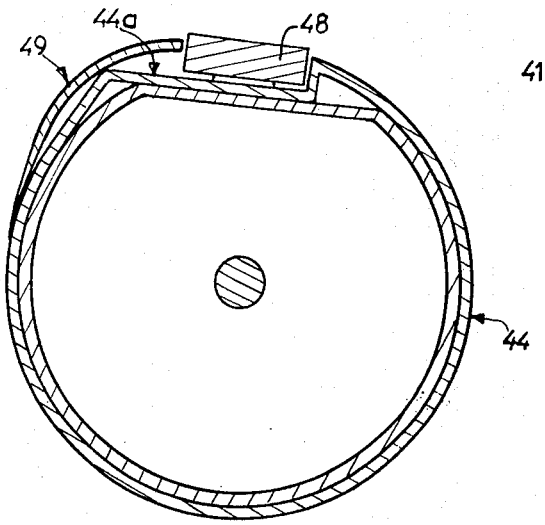

FIG. 10 is a sectional view of the drum in the first variant embodiment.

Figure 11:
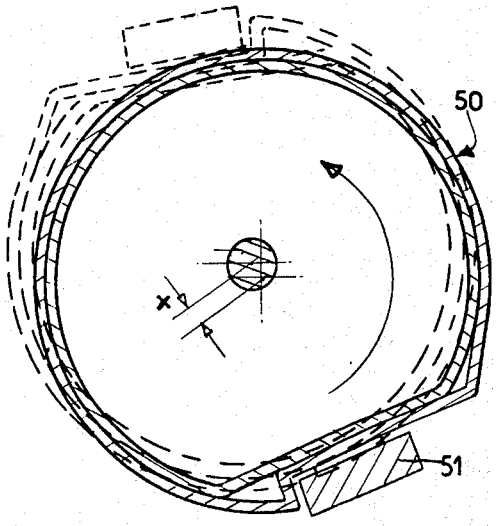

FIG. 11 is a sectional view of the drum in the second variant embodiment.

Figure 12:
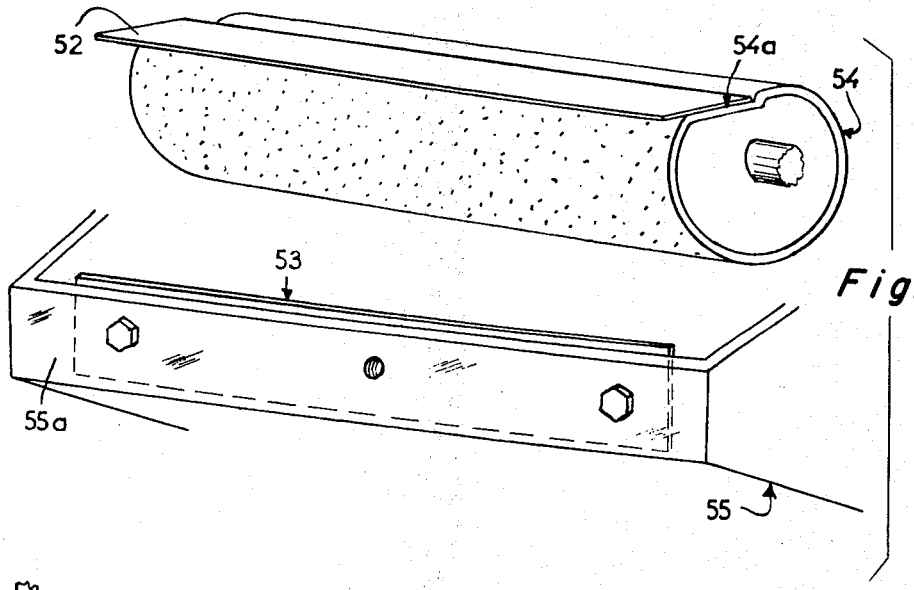

FIG. 12 is a perspective view illustrating the drum and support having the spring steel blade and matching blade.

Figure 13:
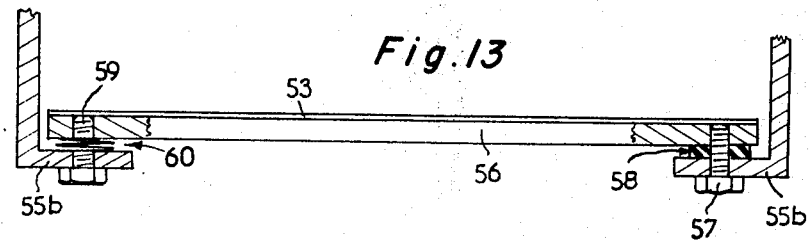
Figure 14:
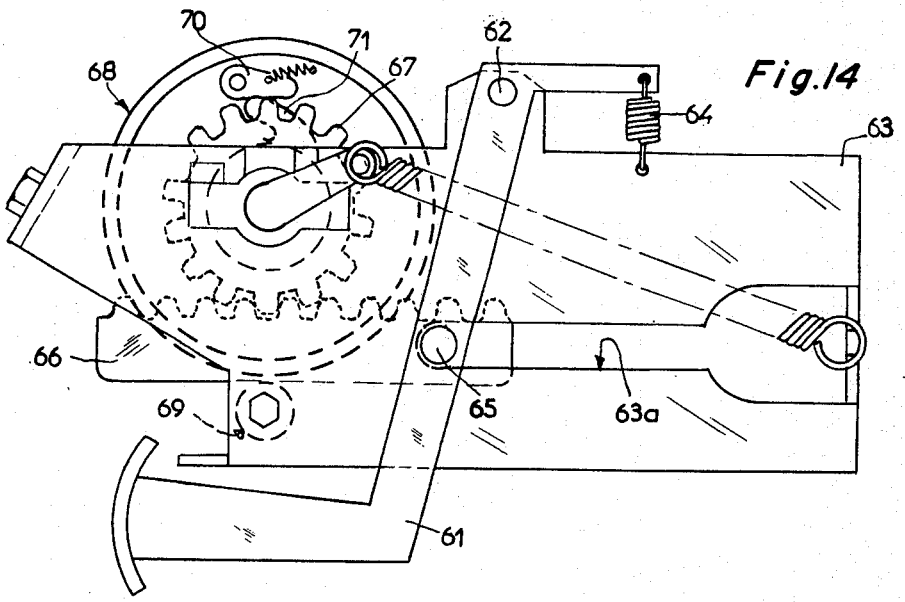

FIG. 13 is a plan view, partially sectioned, illustrating the mounting of the matching blade on the support, and FIG. 14 is a sectional view illustrating the mounting of the drum pedal drive.

To explain the subject matter of the invention in a more concrete manner, non-limitative embodiments thereof will now be described with reference to the drawings.

Figure 1:
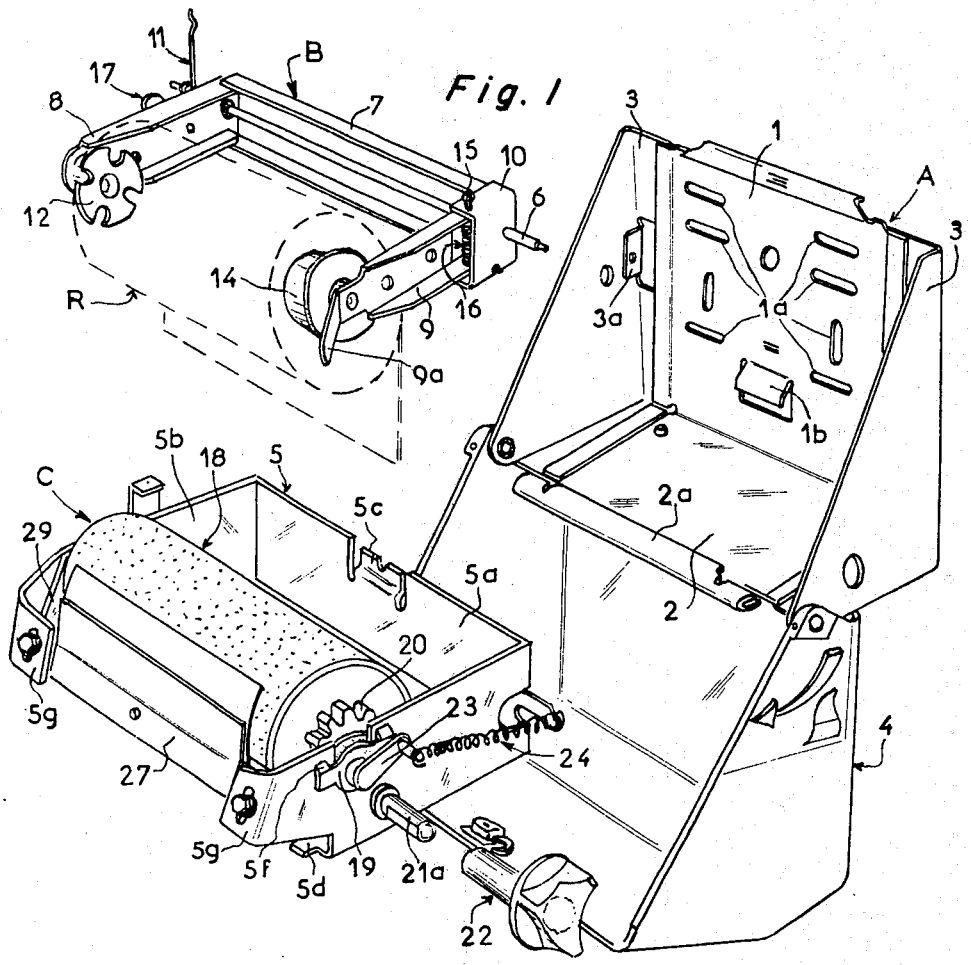
FIG. 1 is a perspective view showing the three main elements of the apparatus separated from one another.

FIG. 1 shows the main elements of which the apparatus is made up, namely a wall mounted casing A, a roller support B and a unit C supporting mechanisms. The wall mounted casing comprises a plate of square sheet metal forming the vertical end 1 and a base 2. Attached to the sides of the end and base are folded over flanges 3 of generally triangular shape to which a sheet metal or plastics hood 4 is articulated.

The end metal sheet 1 is formed with vertical and horizontal cutaway portions **1*a* for attachment, and adjacent its lower portion it is formed with a re-entrant tongue 1*b*. The base 2 is folded on itself at 2*a* along its free side. These two points, namely the tongue 1*b* and the flange 2*a* are adapted to receive by latching the unit bearing the mechanisms which has to this end a frame 5 made up of an end 5*a* and two flanges 5*b*. The end 5*a* forms in its upper portion a coupling 5*c* on the outside which engages under the tongue 1*b* of the casing, while the flanges 5*b* form at their bent over lower edges projections 5*d* which can engage under the folded flange 2*a* of the casing. The roller support is also mounted simply by latching on to the casing, via a stepped shaft 6 which extends through the roller support and overlaps laterally and engages resiliently in apertures in tongues 3*a* of the flanges 3 of the casing, the tongues being bent over parallel with such flanges. The roller support is formed by a sectional iron 7 to one end of which fixed arm 8 is attached, a movable arm 9** being articulated at the other end.

The connecting shaft 6 articulated to the flanges of the casing extends through the fixed arm and the U-shaped plate 10 which is connected to the iron 7 and to which the movable arm 9 is articulated. To keep the roll of material R constantly bearing against the drum, a spring 11 is provided on the shaft, one end of the spring bearing compressively against the casing.

Figure 2:
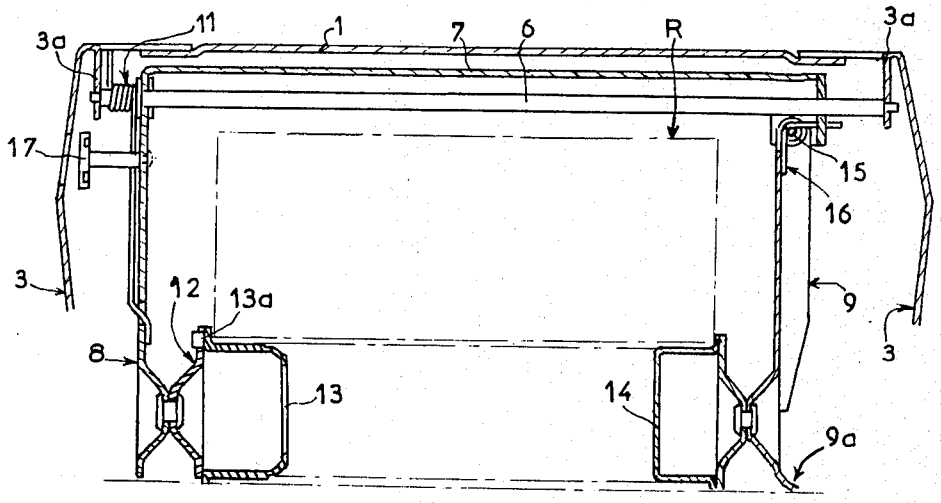
FIG. 2 is a sectional view of the support for the roll of material latched on to the casing.

The roller R is borne for rotation on the side of the fixed arm by a notched washer 12 cooperating with the tip 13 with projections **13*a* which engages in the hub of the roller (FIG. 2). On the opposite side the movable arm 9 bears a sleeve 14 engaging in the roller hub. The movable arm 9 is articulated by a pin 15 and returned resiliently to be forced against the roller by a suitably disposed helical spring 16. The arm 9 also has an inclined end 9*a* enabling it to be grasped easily. For the correct assembly of the roller, a brightly coloured reference mark 17 is made on the fixed arm 8**.

The unit supporting the mechanisms receives the members required for cutting, more particularly the drum 18 for driving the material by its engaging periphery **18*a* borne for rotation by bearings 19 engaging by their circular hub in a notch 5*f* formed in the flanges 5*b* of the frame and indexed in rotation by prolongations 19*a* bearing beneath or against tongues 5*f* of the flanges. On the inside the bearings support for free rotation a driven pinion 20 meshing with the drive pinion 21** (FIG. 7) borne freely rotatably by the flange 5*b* and having a projecting bearing surface 21*a* adapted to receive an operating member (button 22 or the like). An eccentric lever 23 connected to return spring 24 operates in known manner the start-up of the drum when a pull is exerted on the material.

Figure 3:
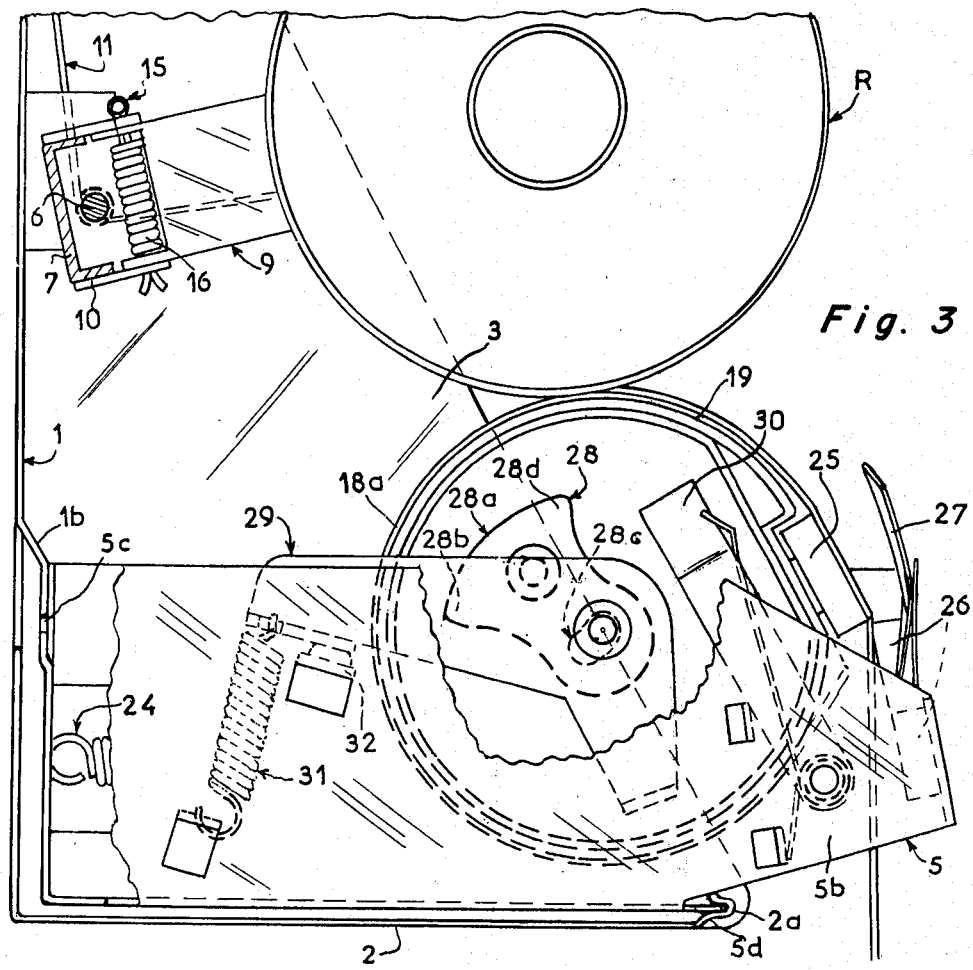
FIG. 3 is a partially sectioned view illustrating the unit supporting the mechanisms in its position at the start of cutting.

The drum bears a blade 25, while the folded upper ends 5*g* of the flanges bear in adjustable manner the twisted matching blade 26 to which a deflector 27 is attached to guide the material. Opposite the pinion 20 a pawl 28 and a shock absorber or parachute 29 are disposed on the drum shaft. These two members, and a dog 30 articulated to a flange frame, share in the cutting operation in the following phases: when a pull is exerted on the material, the drum rotates freely to bring the blade 25 into contact with the matching blade 26, with a certain force produced by the effect of the eccentric 23 and its spring 24 (FIG. 3). The portion 28 forming the cam of the pawl passes in front of the dog and moves it away.

After cutting, the inertia of the drum makes it continue to describe a certain arc of a circle, until the end 28*b* of the pawl contacts a square portion 29*a* of the parachute which is then rotated (FIG. 4). The parachute is resiliently retained by spring 31. The drum is decelerated and stops. The parachute returns to bear resiliently against a stop 32 formed in a flange, this causing a rebound effect. The pawl then bears at a place 28*d* beneath a squared portion 30*a* of the dog, thus prevent the return of the drum (FIG. 5).

Clearly, since the pawl is mounted on the drum shaft by a slot 28*c* and indexed by a shaft 33, merely by its own weight the pawl, in dependence on its angular position, tilts on the slot; either to abut the parachute in the free fall movement, or to escape from the parachute when a fresh pull is exerted on the material. These arrangements correspond to an automatic version of the apparatus — i.e., one which delivers a strip of material every time a manual pull is exerted on the paper, without any other manipulations.

FIG. 6 illustrates a semi-automatic version — i.e., one which after each pull requires further action to enable a fresh strip to be pulled, thus limiting wastage.

To this effect a pawl 34 of different shape is provided which constantly abuts by its projection 34*a* the square portion 29*a* of the parachute, while the other end 34*b* of the cam 34*c* can bear beneath the square portion 35*a* of a dog 35 when the parachute is pivoted to meet its spring at the end of the free fall.

To release the drum and therefore the pawl 34 from the parachute, action is taken on a bolt 36 which is guided inside the flange 5*b* of the frame and has a projection 36*a* adapted to push the square (bevelled) portion 29*a* of the parachute. The bolt 36 is automatically returned when action ceases to be taken on its outside button 36*b*, by a spring 37 connected to a tongue of the base of the casing.

The mechanisms can also be so disposed that after the material has been pulled and cut and the parachute and stop effects have been produced the material does not project beneath the hood, so as to limit wastage. In that case the emergence of the material is obtained by further action. FIG. 8 shows diagrammatically by way of example the control of the emergence of the material by a pusher lever 38 which can act on a projection 39 suitably disposed at one end of the drum, to rotate the drum and therefore the material. An anti-return means such as a ratchet 40 is provided which cooperates with the pinion 20 or the pinion 21.

The button 22 is adapted to unblock the mechanisms if the material has not been properly pulled, so that it is jammed between the blades. The button 22 can readily be replaced by a crank, so that the material can be distributed and cut by direction action on the crank.

The pawl is made of a particular material to meet the conditions of use, namely resilience, resistance to impact and wear, lightweight, the selected material being the known polyurethane known by the Trade Mark "Eladip and Desmopan.

In the embodiments illustrated in FIGS. 10 – 14 it will be remembered, referring to FIG. 9, that the device comprises a support 41 detachably fixed to the wall mounted casing 42 and bearing a matching plate 43, and the drum 44 and a roll of material 45 carried in free rotation by a roller support 46 which can move angularly and it is attached to the flanges of the casing, and closure hood 47 being provided.

According to one feature, the drum 44 whose periphery has a notch 44*a* or a flat to which cutting blade 48 is attached, via resilient washers and screws, has a raised portion (as the sheet metal plate 49 in FIG. 10) welded or otherwise attached to the periphery and extending in front of the cutting blade in relation to the rotary movement. The raised portion forms an eccentricity allowing a gentler pulling movement on the material — i.e., a certain progressivity, preventing the material from being spoilt in any way, for instance, when the operators' hands are wet.

With the same object of making the operation progressive (FIG. 11) the drum 50 is mounted with some eccentricity *x* substantially opposite the point of attachment of the blade 51. The eccentricity enables the operation to be progressive during the rotation of the drum, and also enables the angular projection movement of the drum to be accentuated to improve cutting.

In another feature (FIG. 12) the blade and matching blade, initially of bar-type, are replaced by thin (2–3-tenths of a millimeter) spring steel blades 52 and matching blades 53. The blade 52 can advantageously be glued or otherwise attached directly to a depression or flat 54*a* of the drum 54.

In both this variant and the preceding variants (raising and eccentricity) the drum can be made of plastics or wood, therefore greatly simplifying its manufacture and reducing its cost price.

The matching plate 53 is connected to a front, twisted and inclined portion 55*a* of the support 55 either directly by its attachment points (FIG. 12), or via a twisted supporting bar 56 to which the matching blade is glued or otherwise attached and whose ends are connected to flanges 55*b* of the support 55 (FIG. 13).

The matching blade or supporting bar is attached to a support floatably, namely at the highest end (start of cutting) by a screw 57 extending through flange 55*b* of the support and the matching blade or bar, between which an elastomeric washer 58 is inserted. At the lowest end (end of cutting) the attachment is by a screw 59 extending through the flange 55*b* and the matching blade or its supporting bar, between which a resilient member, such as a helical spring 60 is inserted.

In a last feature (FIG. 14) the emergence or simultaneous distribution and cutting of the material is performed by a mechanical means comprising a pedal 61 of hand support shape which is articulated at a place 62 to the support 63 and resiliently returned to the advanced position by a spring 64. In its central portion the pedal is completely articulated at a place 65 to a rack 66 cooperating with a pinion 67 chocked on the shaft of the drum 68. The rack is guided longitudinally by articulating shafts 65 sliding in a groove 63*a* over the support and by bearing at the front against a roller or bearing 69 aligned on the support. A spring pawl 70 articulated to the drum cooperates at the end of travel with a stop 71 connected to the pinion 67. In this assembly a different position can be given to the pawl cooperating with the parachute and dog sharing in the movements of the drum, and also to the eccentric lever for starting up the drum, so that the material does not overlap after cutting.

The advantages are well shown up in the description, more particularly:

The pawl is progressive and so is the increase in the inertia effect, due to the eccentric mounting of the drum or the addition of the raised portion.

The drum is simplified and the matching blade support is simplified by spring steel blades and matching blades.

No control system is necessary and the cutting is neater as a result of the floatable mounting of the matching blade.

There is less wear with the spring steel blades and matching blades.

We claim:

1. Apparatus for dispensing strips of wound material, comprising a carrier for a roll of sheet material, a rotatable drum in abutting relationship with said roll of sheet material, a cutting device for said material comprising a fixed member with means for adjusting said fixed member and a movable member, said movable member cooperating with said fixed member to effect cutting mounted on said drum, means to latch the drum onto the vertical end walls respectively of a wall-mounted casing for said apparatus, a stepped shaft which extends through such drum and engages resiliently in apertures in hooked tongues on flanges of said casing and a supporting unit latched on to the horizontal base and end walls of said casing for said apparatus, projection means with which a lower portion of a flange frame is formed, such projections engaging beneath a folded edge of the base of the casing, and a coupling with which the end wall of such frame is formed, such coupling engaging beneath an inner hook with which the vertical wall of the casing is formed and assembled in a wall-mounted casing having a hood, a pawl of sectional shape to coact with a shock-absorbing member of said drum and an anti-return dog on the drum.

2. Apparatus as in claim 1, wherein the fixed member and the movable member of the cutting device comprises very thin blades of spring steel to enable cutting the material being distributed by pulling caused by the rotation of the drum mounted on an eccentric.

3. Apparatus as in claim 1, wherein the spring steel cutting blade borne by the drum is directly attached with an overlap in a depression or flat of the periphery of the drum.

4. Apparatus as in claim 1, wherein the fixed cutting blade is connected to a support at the highest end by means of a screw extending through the support and the blade with an elastomeric washer inserted therebetween, and at the lowest end by means of a screw extending through a support and the blade with a helical spring-type resilient member inserted therebetween.

5. Apparatus as in claim 1, wherein the drum has located in front of the bar-type or spring steel cutting blade, a raised portion of the periphery formed by a metal plate attached to the drum adapted to enhance the rotation of the material when pulled manually.

6. Apparatus as in claim 1, wherein the drum is mounted with an eccentricity substantially opposed to the cutting blade, in order to enhance the rotation of the material during manual pulling.

7. Apparatus as in claim 1, wherein the drum is rotated for the simultaneous dispensing and cutting of the material by means of a resiliently returnable pedal aligned on the drum support and articulated to a rack guided in traversing movement in said support and cooperating with a pinion connected to the drum having pawl and travel stop.

8. Apparatus as set forth in claim 1, wherein the rotatable drum is aligned on the frame by bearings, a hub engaging in a notch in the frame which is indexed in rotation by a prolongation of the bearings simply bearing against hook-tongues of the frame disposed on either side of the notch and said drum also having at one end a sectional pawl mounted on a roller shaft by a slot means and indexed in rotation on such roller, said pawl having a cam with an end cooperating, while the drum rotates further following the cutting action, with the squared portion of a spring biased brake mounted on the drum shaft, stop spring means for decelerating the drum by tilting the pawl through its slot with the other end of the cam bearing against a squared portion of a dog articulated to the flange frame during the rebound caused by the return of the spring biased brake onto a resilient stop and pinion means engaging with the pinion coaxial with the drum having an external bearing surface.

9. Apparatus as in claim 8, wherein the drum has a button for unblocking the mechanism caused by jamming because of incomplete pulling of the material.

10. Apparatus as in claim 8, wherein the bearing surface has a crank for supplying strips of material.

11. Apparatus as in claim 8, wherein the cam pawl is so constructed that when the drum has been decelerated by the spring biased brake and has abutted the dog, its slot enables it to escape from said spring biased brake when a fresh pull is exerted on the material.

12. Apparatus as in claim 8, wherein the cam pawl is so constructed that after the drum has been decelerated by the spring biased brake, the pawl cannot escape said brake except by manual action being taken on a bolt releasing the pawl from said spring biased brake.

13. Apparatus as in claim 8, wherein the pawl means, the spring biased brake and the dog are so positioned that after a strip of material has been cut, the drum does not allow a fresh strip to emerge and a pusher-lever cooperating with a drum-driving projection and a ratchet on one of the drum drive pinions to enable a fresh strip of material to emerge by additional manual action.

* * * * *